US005588695A

United States Patent [19]

Gomes

[11] Patent Number: 5,588,695

[45] Date of Patent: Dec. 31, 1996

[54] FOLDABLE BEACH CHAIR

[76] Inventor: Daniel Gomes, P.O. Box 117, Worcester, N.Y. 12197-0117

[21] Appl. No.: 444,656

[22] Filed: May 19, 1995

Related U.S. Application Data

[63] Continuation-in-part of Ser. No. 553,163, Jul. 13, 1990, abandoned.

[51] Int. Cl.[6] ..... A47C 4/00

[52] U.S. Cl. ..... 297/56; 297/447.2; 297/184.16; 297/410; 297/403; 297/463.1

[58] Field of Search ..... 297/16, 18, 24, 297/31, 46, 56, 184.1, 184.15, 184.16, 270.1, 270.5, 310, 394, 396, 397, 399–404, 440.1, 440.15, 445.1, 446.1, 447.1, 447.2, 449.1, 463.1; 248/118, 449, 295.1

[56] References Cited

U.S. PATENT DOCUMENTS

| | | | |
|---|---|---|---|
| 146,907 | 1/1874 | Hills | 297/402 |
| 169,772 | 11/1875 | Cadwallader | 297/270 |
| 240,873 | 8/1976 | Lewis et al. . | |
| 242,193 | 11/1976 | Joiner . | |
| 242,380 | 5/1881 | Sharp | 297/400 |
| 900,572 | 10/1908 | Morton | 297/184 |
| 1,597,355 | 8/1926 | Fussell | 297/399 |
| 3,907,359 | 9/1975 | Joiner | 297/56 |
| 4,743,068 | 5/1988 | Gomes | 297/56 |

FOREIGN PATENT DOCUMENTS

| | | | |
|---|---|---|---|
| 818311 | 9/1937 | France | 297/184 |
| 2363302 | 5/1978 | France | 297/56 |
| 9247 | 4/1911 | United Kingdom | 248/449 |

*Primary Examiner*—Milton Nelson, Jr.
*Attorney, Agent, or Firm*—Barnard, Brown & Michaels

[57] ABSTRACT

A foldable chair is disclosed herein. The chair is made from a plurality of back, seat and intermediate members. The back members are joined along the top. The seat members are joined along the front. The other end of the back and seat members are joined to opposite ends of the intermediate members to from hinged joints that allow the chair to be folded and unfolded. Leg members extend from at least two of the back members and at least one of the seat members. The inner seat width of the chair is approximately equal to the length of the back of the chair. The members not functioning as leg members are sized to minimize the outward force on the joints during opening and closing of the chair. Tip prevention members, adjustment techniques and a headrest are also disclosed.

21 Claims, 6 Drawing Sheets

FOLDABLE BEACH CHAIR

This is a continuation-in-part, of application Ser. No. 07/553,163, filed Aug. 13, 1990, now abandoned.

BACKGROUND OF THE INVENTION

1. Field Of The Invention

The present invention relates to foldable chairs and more particularly relates to foldable chairs that are small enough to be used as beach chairs.

2. Background

Articles of foldable furniture that consist of several pieces, each capable of rotation relative to each other, are well known. One type of folding chair has several pieces making up the seat, back and legs of the chair. In a typical design each piece has a bore through which a metal wire or flexible bolt is passed. Each piece is strung on this wire or bolt until the full completion of the chair. When the article of furniture is completely assembled, each portion of the chair is capable of rotation relative to the others, thereby allowing the chair to fold out into an open position for use, or to fold into a closed compact position suitable for storage. Chairs of this type are shown in U.S. Pat. Nos. Des. 240,873, Des. 242,193, 3,907,359 and 4,743,068. Chairs of this type are extremely comfortable because the flexible bolts joining the chairs allow the chairs to curve and be somewhat flexible and the chairs provide support along the spinal column, especially along the lower back because the user's knees are: positioned higher than his pelvis thereby rounding out his lower back and distributing weight and support between his buttocks an lower back. Chairs of this type have previously been constructed as relatively large, heavy patio furniture which would be cumbersome and impractical for use as a portable beach chair.

A chair of this type that has been scaled down to be small enough to be used as a beach chair is shown as prior art in FIG. 7–9. The primary problem with the scaled down chair as shown that it is uncomfortable and cumbersome to the user. The wooden members used to construct the chair still are required to support the same amount of weight so when the chair was scaled down the width of the wooden members was not decreased but the seat width was greatly diminished by decreasing the number of wooden members This made the seat less curved, less flexible and provided much less support for the user. As the chair is opened the members twist and push outward thus placing a great deal of pressure on the wire or bolt holding the chair together and also making the Chair much more difficult to open and close than the larger chairs.

The legs of the scaled down chair are shorter than the legs of the larger chair thereby making the smaller chair easier to tip forward. This makes sitting down and shifting in the chair precarious and dangerous for children. Furthermore, the small chair does not stand up when folded making it cumbersome to store.

The scaled down version does not support the neck or head like the larger version, also making the user less comfortable. The larger chair only supports the neck and head by the length of the back of the chair. Padding has been added to the upper portion of the back of some of the larger chairs; however, this padding is not adjustable to the different needs of each user.

SUMMARY OF THE INVENTION

It is, therefore, the primary object of the present invention to provide a foldable chair small enough to be used as a beach chair that is comfortable for the user.

It is a further object of the present invention to provide a foldable chair small enough to be used as a beach chair wherein the seat width is of adequate size to provide comfort and support to the user.

It is a further object of the present invention to provide a foldable chair small enough to be used as a beach chair that includes members forming the chair that minimize the pressure placed on the wire or bolts holding the chair together as the chair is folded and unfolded, minimize the overall weight of the chair, maximize curvature and flexibility, and provide sufficient structural support.

It is a further object of the present invention to provide a foldable chair small enough to be used as a beach chair that includes means for preventing the chair from tipping forward while the user is sitting down or shifting in the chair.

It is a further object of the present invention to provide a foldable chair small enough to be used as a beach chair that can support itself in an upright position when folded.

It is a further object of the present invention to provide a foldable chair small enough to be used as a beach chair that provides support for the neck and head of the user.

It is a further object of the present invention to provide a head rest for a foldable chair that is continuously adjustable and provides support for the neck and head of the user.

The teachings of the present invention include the discovery that as a chair as previously shown in U.S. Pat. No. 3,907,359 is scaled down into a smaller chair, certain proportions are critical for comfort. While the desired chair is smaller, the user is the same size. The present invention teaches that the inner seat width of the chair to be scaled down is critical to provide optimum chair curvature, flexibility and comfort. So the inner seat width is not reduced while the lengths of the back, legs and seat are reduced.

A foldable chair, constructed in accordance with the teachings of the present invention, comprises back members joined together along the top of the chair, seat members joined together along the front of the chair and intermediate seat members interlaced between the back and seat members. The intermediate members are joined to each back and seat member such that hinged joints are formed from the connections of one end of the intermediate members to the back members and from the connection of the other end of the intermediate members to the seat members. Leg members extend from the back members and the seat members such that the chair is supported above the ground or floor and remains upright when folded up for storage or folded down for use. A proportional relationship exists between the inner seat width of the chair, the length of the back of the chair and the length of the seat of the chair, wherein the inner seat width of the chair is approximately equal to the length of the back of the chair and the inner seat width is greater than the length of the seat of the chair. The back and seat members not functioning as leg members and the intermediate members are proportioned such that the outward force increasing the inner seat width of the chair caused by the folding and unfolding of the chair is minimized, the overall weight of the chair is minimized, the curvature and flexibility of the chair is maximized, and the structural support capacity of the chair is still sufficient to support a large person.

These proportional relationships would not be possible with chairs constructed in the same fashion as the prior art.

The present invention teaches that such a chair can be constructed by sizing the members, not serving as leg members, such that their width is greater than or equal to their height. Furthermore, wear on the members can be reduced by rounding the edges of the members.

The present invention includes a foldable chair that is prevented from tipping by at least one tip prevention member joined along the front of the chair between the seat member such that the tip prevention member can be extended downward or stored when the chair is in use and their length is equal to the distance from the front of the chair to the ground when an average person is seated in the chair and the tip prevention member prevents the chair from tipping forward. Tipping can also be prevented by making the front legs, formed by the longest back members, curved toward the front of the seat of the chair when it is opened to move the point where the front legs touch the ground further forward of the center of gravity.

The foldable chair may include an adjustable head rest apparatus attached to the chair. The head rest apparatus of the present invention includes a moveable head rest portion comprising at least two arms, at least two spacers separating and connecting the arms and a portion for supporting a head of a user. The apparatus also includes an extension member, connected to the chair, upon which the head rest portion can slide up and down, wherein the extension arm can be inserted through the space between the spacers and the arms. The head rest portion is connected to and moveable along the extension arm by a length of material and means for retaining the length of material between two points on the extension member. The length of material wraps around at least a portion of the head rest portion such that the head rest portion is held in place by the frictional force between the length of material and the head rest portion yet is still movable along the extension arm.

These and other objects, features and advantages of the present invention should become apparent from the following description when taken in conjunction with the accompanying drawings.

DETAILED DESCRIPTION OF THE PREFERRED EMBODIMENT

Figure 1:
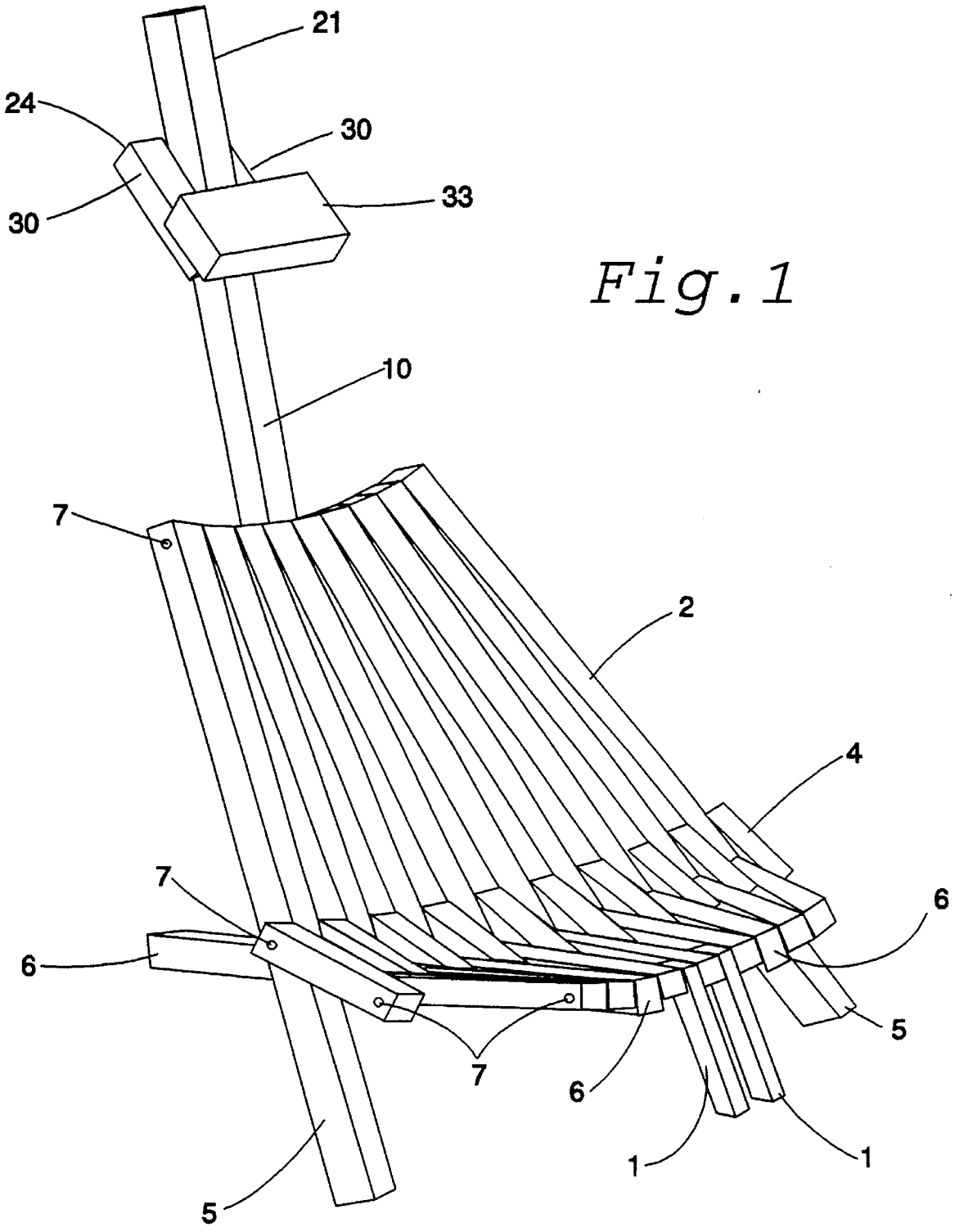
FIG. 1 is an orthogonal view of a chair constructed in accordance with the present invention, when the chair is unfolded.
Figure 2:
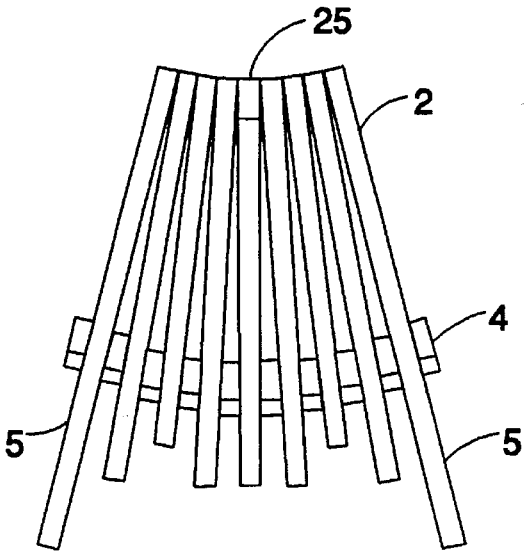
FIG. 2 is a back view of a chair constructed in accordance with the present, invention, when the chair is folded.

For the purposes of promoting an understanding of the teachings of the present invention, references will now be made to the embodiments illustrated in the drawings and specific language will be used to describe these embodiments. It will nevertheless be understood that no limitation of the scope of the invention is thereby intended, alterations and further applications of the teachings of the present invention as illustrated and described hereinabove is anticipated by those skilled in this art.

Figure 6:
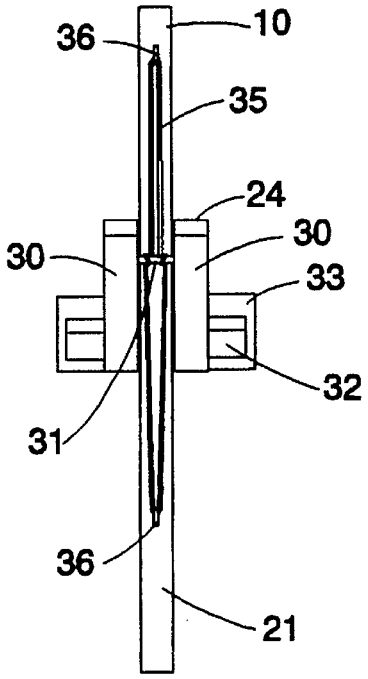
FIG. 6 is a drawing of a head rest constructed in accordance with the present invention.
Figure 7:
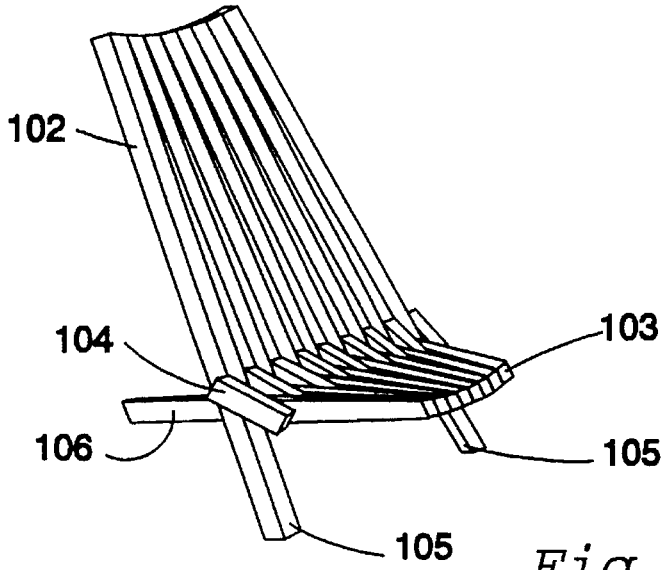
Fig. 7 Prior Art
FIG. 7 is an orthogonal view of a scaled down chair as previously constructed, when the chair is unfolded.
Figure 8:
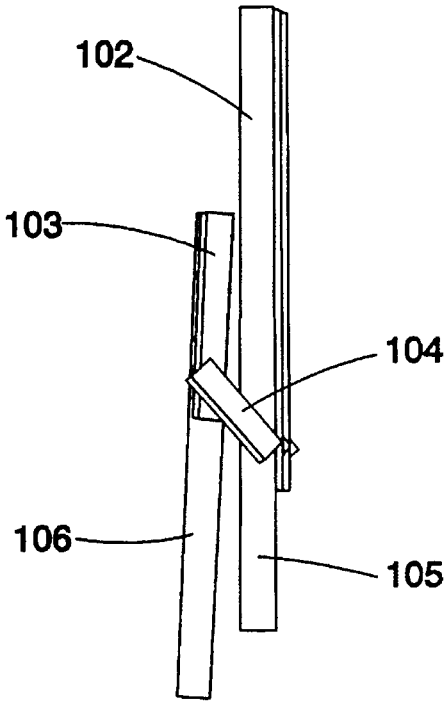
Fig. 8 Prior Art
FIG. 8 is a side view of a scaled down chair as previously constructed, when the chair is folded.
Figure 9:
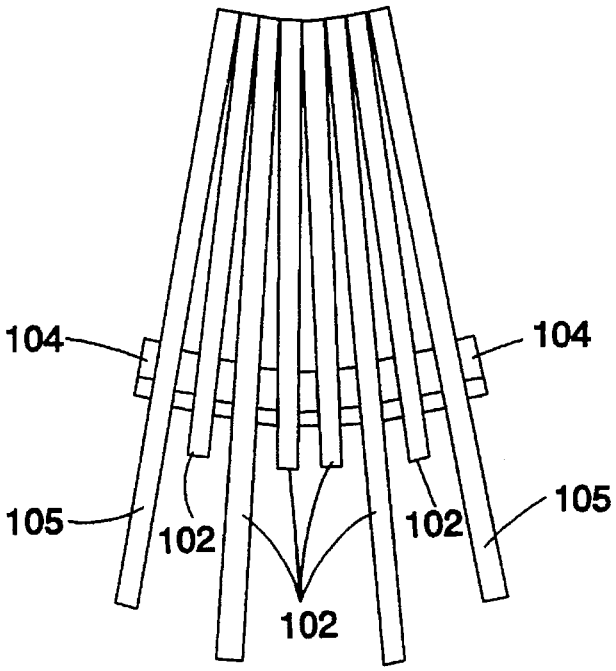
Fig. 9 Prior Art
FIG. 9 is a back view of a scaled down chair as previously constructed, when the chair is folded.

A foldable chair made prior to the chair taught by the present invention is shown in FIGS. 7–9 and the reference numerals used to particularly point out and describe this chair as shown are all between 100 and 150. A chair and particular features of the chair constructed in accordance with the teachings of the present invention is shown and described in FIGS. 1–6 and the reference numerals used to particularly point out and describe this chair as shown are all between 1 and 50.

Figure 4:
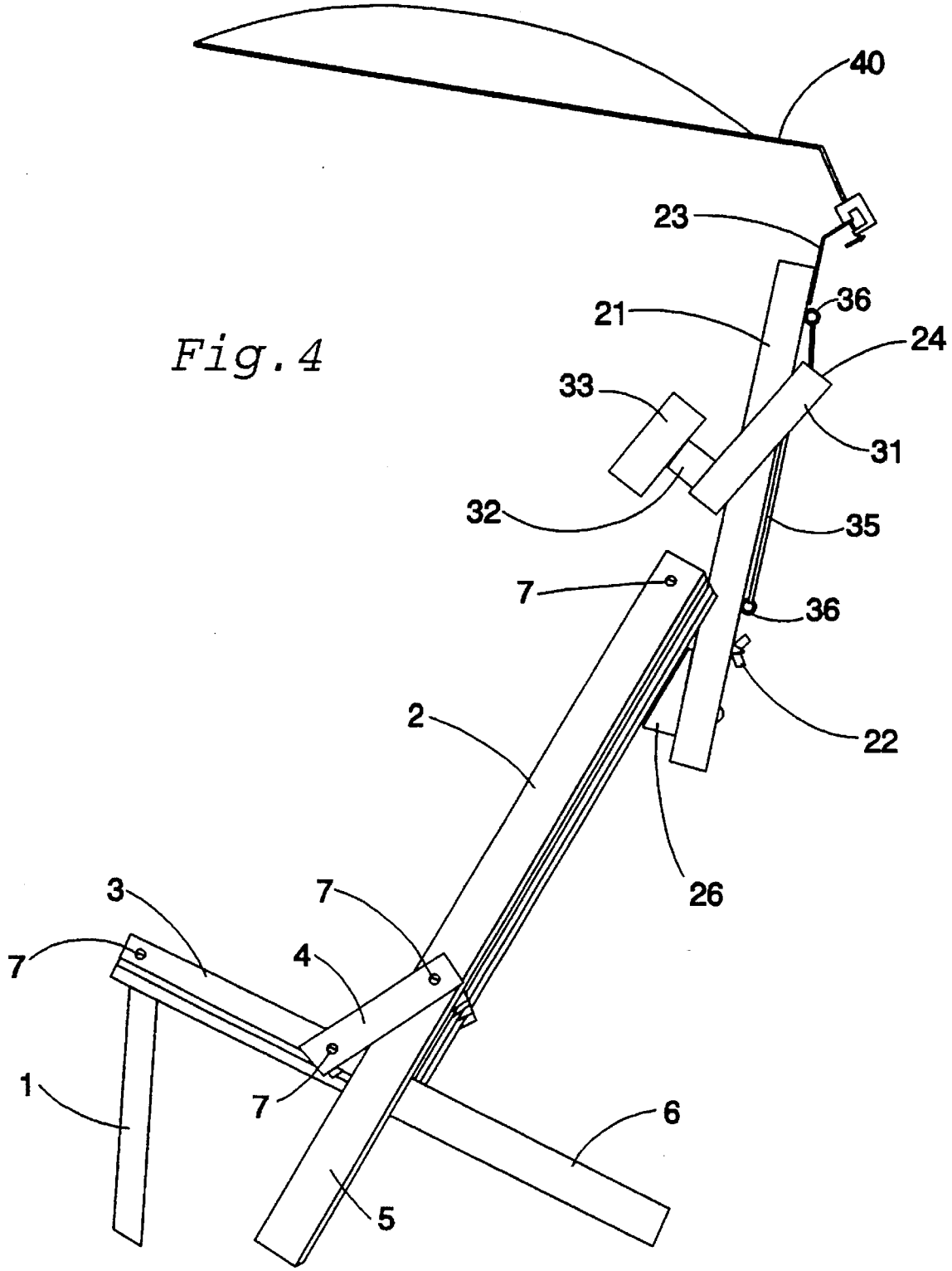
FIG. 4 a side view of a chair constructed in accordance with the present invention, when the chair is unfolded.

Referring specifically now to FIGS. 1 and 7, both chairs comprise back members 2 and 102 and seat members 3 and 103 which are joined by intermediate members 4 and 104 which are interlaced between the back members 2 and 102 and seat members 3 and 103. The members are connected as flexible and pivotable joints by wire 107 or flexible bolts 7. The flexible bolts 7 pass through holes drilled in each member. Included with the back members 2 and 102 are two front legs 5 and 105 and included with the seat members 3 and 103 are two back legs 6 and 106. The connections between the members are designed to allow the pieces to rotate relative to one another so that the chairs can be folded into a closed position as shown in FIGS. 4 and 8. The members in the embodiments illustrated are of wood but could also be of metal or plastic.

The chair shown in FIGS. 7–9 is a scaled down version of a chair as described in U.S. Pat. No. 3,907,359. The ratio of the length of the back members 102 and the inner seat width of the scaled down chair remained approximately the same as in the larger chair. The number of members in the chair was decreased; however, the width of the members remained the same. As can be seen from FIG. 7, the curve and size of the inner seat width of the scaled down chair is much smaller than a chair constructed in accordance with the teachings of the present invention as shown in FIG. 1.

As described hereinabove the joints of the chairs shown in FIGS. 1 and 7 are flexible and designed such that each chair may be folded. As each chair is closed a certain amount of twisting and shifting of the members occurs which increases the pressure on the means holding the joints together. As can be seen in FIG. 9, the twisting of the outer intermediate members 104 forces the outer back members 102 apart. (For clarity, the seat members 103 are not shown in FIG. 9.) The effect of the twisting of these members is increased by the fact that the intermediate members 102 are rectangular in shape. Even though the scaled down chair is smaller it still must be capable of supporting the same amount of weight. The chair of the present invention is designed to overcome the above problem and careful consideration was made to determine how and what members should be changed.

A chair constructed in accordance with the teachings of the present invention includes back members 2 joined together along the top of the chair, seat members 3 joined together along the front of the chair, intermediate members 4 interlaced between the back members 2 and seat members 3 and connected to each member such that flexible and pivotable joints are formed from the connections of one end of the intermediate members 4 to the back members 2 and from the connection of the other end of the intermediate members 4 to the seat members 3. Leg members 5 and 6 extend from the back members 5 and the seat members 6 such that the chair is supported above the ground or floor. A proportional relationship exists between the inner seat width of the chair, the length of the back of the chair and the length of the seat of the chair, wherein the inner seat width of the chair is approximately equal to the length of the back of the chair and the inner seat width is greater than the length of the seat of the chair. The inner seat width is defined by the combined widths of the back members and the intermediate members. The chair can be constructed to have an inner seat width that is equal to or greater than the distance between the connection of the intermediate member to the back member and the top of the back member.

The members not functioning as leg members 5 and 6 are designed and proportioned such that the outward force on the means for joining the members caused by the folding and unfolding of the chair is kept to a minimum. Most of the weight of the user is supported by the leg members 5 and 6. As shown, the back, seat and intermediate members not functioning as leg members are square in cross-section. If need be, the leg members 5 and 6 can still be rectangular in shape to be capable of supporting the weight of a large user, while the rest of the members are square. The reduction in size of the members not functioning as leg members reduces the weight of the chair making it less cumbersome to the user when used as a beach chair. The reduction in size also gives the chair more curvature and flexibility.

Figure 10:
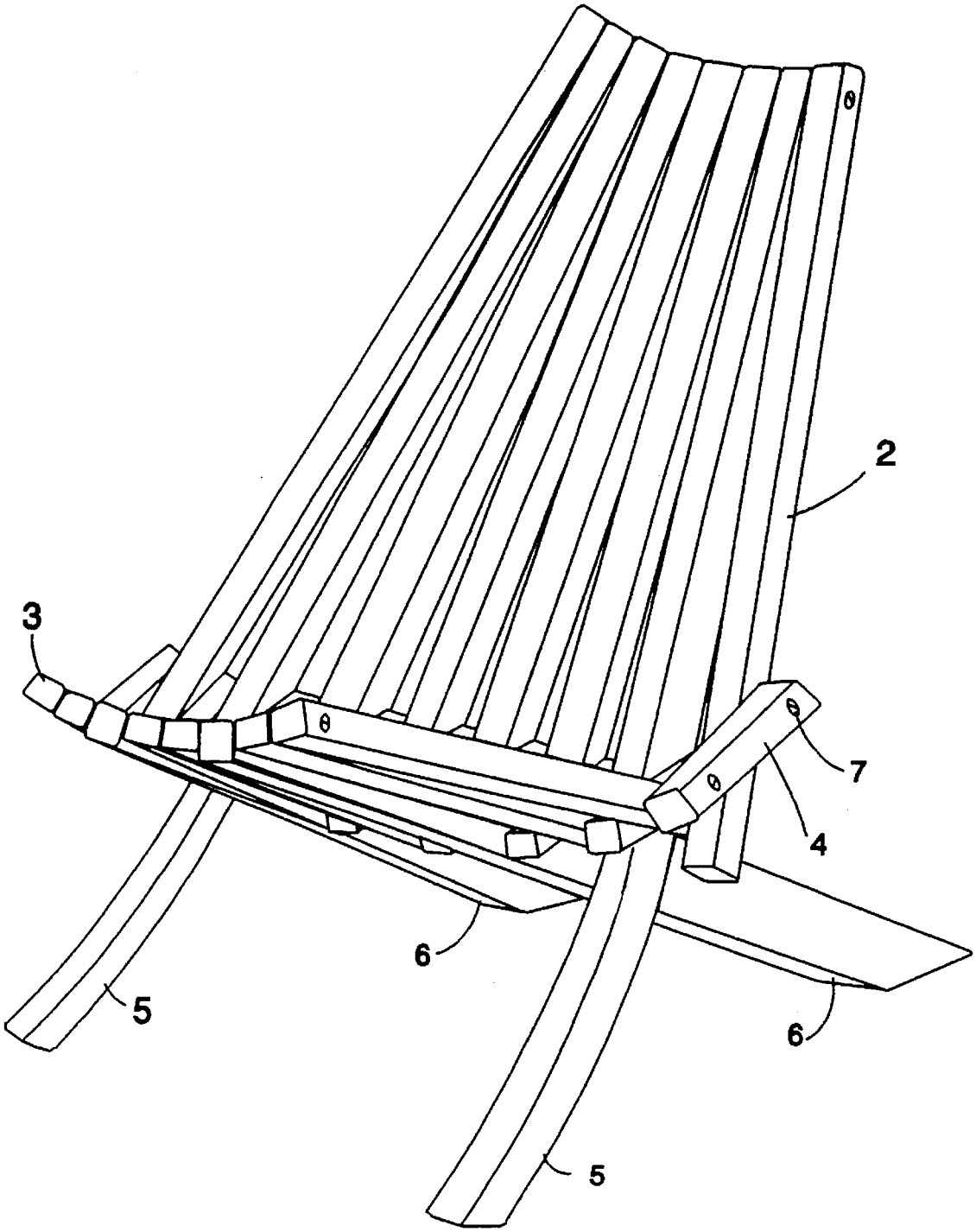
FIG. 10 is an orthogonal view of another embodiment of a chair constructed in accordance with the teaching of the present invention showing curved legs and rectangular members.
Figure 11:
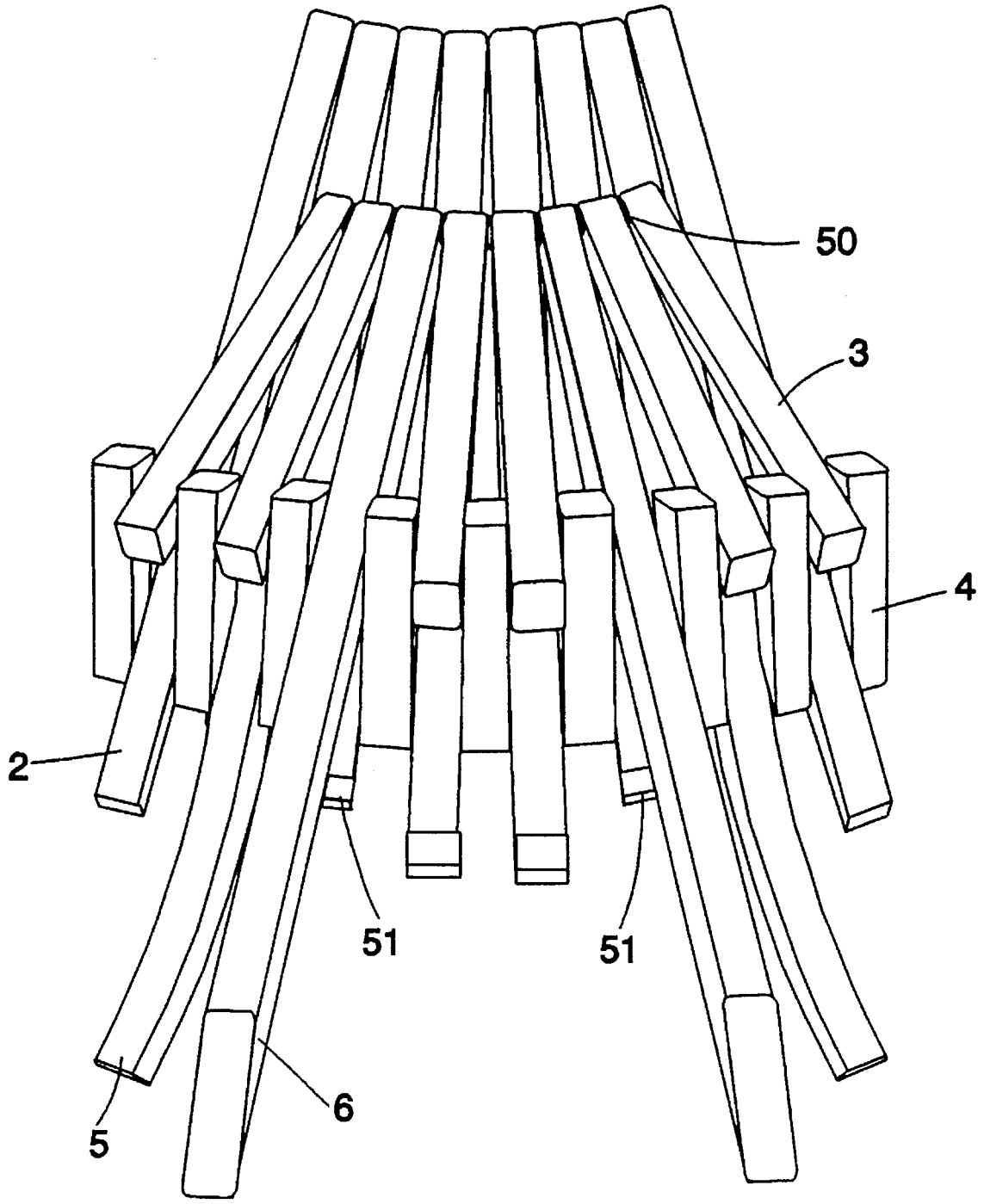
FIG. 11 is front view of a folded chair shown in FIG. 10 and shows end caps on two of the members for adjusting the angle of the back of the chair.

The present invention also teaches that such a chair can be constructed by sizing the members, not serving as leg members, such that their width is greater than their height as shown in FIG. 10 and FIG. 11. This orientation is counter-intuitive in that normally the longest dimension would normally be oriented to be parallel to the force being applied by the person seated in the chair. An advantage of using rectangular stock oriented counter-intuitively is that there is less resistance (friction and wear) when the chair is opened and closed. There is also less tension put on the fastening mechanism when the chair is repeatedly opened and closed.

The leg members 5 and 6 extend such that the chair is supported above the ground or floor and remains upright when folded up for storage or folded down for use as shown in FIG. 4. The chair of the present invention will stand by itself which is very convenient on a long walk to the beach when the user desires to stand and rest for a minute. The chair is opened and the legs members 5 and 6 dig into the sand equally due to the fact that they are both resting on the sand when it is folded, thereby providing further stability for the chair. The previously scaled down chair as shown in FIG. 8 does not remain upright when folded up for storage. It is possible to construct a chair with only 3 leg members 5 and 6 by deleting one of the leg members 5 extending from the back of the chair and moving the other leg member 5 to the center of the chair. A three legged chair is less stable than a four legged chair and is therefore not the preferred embodiment of the present invention; however, it is an anticipated modification that can be made by one skilled in the art if so desired.

The small chair is generally less stable than a larger chair because the leg members 5 and 6 are shorter and provide less distance between their ends for balance and support. This makes small chairs precarious for the general user and dangerous for small children. The foldable chair constructed in accordance with the teaching of the present invention also includes tip prevention members 1, as shown in FIG. 4, joined along the front of the chair between the seat members 3 such that the tip prevention members 1 can be extended downward when the chair is in use and their length is equal to the distance from the front of the chair to the ground when an average person is seated in the chair and the tip prevention members 1 prevent the chair from tipping forward. Only one tip prevention member 1 is necessary to provide the desired function, however, two tip prevention members 1 may offer some tip prevention from side to side which is less of a concern and may offer some aesthetic improvement in a chair made with an odd number of seat members 3. The tip prevention members, as shown, 1 fold up into the seat members 3 such that they are held in place and do not interfere with the user sitting in the chair if the user decides not to use them. In this case the height of the chair is designed such that the tip prevention members 1 are the same length as the seat of the chair. This would not be practical if the tip prevention members 1 were included in a larger chair. The function of the tip prevention members 1 could be duplicated by adding an extension to one of the intermediate members 4 such that the extension touched the floor or ground when the chair was unfolded and prevented the chair from tipping forward. A tip prevention member constructed in this manner tends to protrude from the folded chair obtusely making the chair less attractive and slightly more awkward.

As shown in FIG. 10 and FIG. 11, tipping can also be prevented by making the leg members 5 curve toward the front of the chair. The curved leg members 5 result in better stability because the point of contact between the curved leg members 5 and the floor is shifted forward from the center of gravity of the occupied chair. This eliminates the need for the tip prevention members 1. Since the curved leg members 5 are part of the back assembly, the curved part of the legs conveniently do not stick out when the chair is in the folded position, but rather inwards towards the other side of the folded chair. Therefore, the curved leg member 5 version of the chair fits in the same box when assembled.

The curved leg members 5 can be made in wood by cutting, laminating or steam bending. The least expensive method for manufacture would be to make them out of molded plastic (preferably recycled plastic) simulated to look like wood.

When eliminating the tip prevention members 1, the front of the seat became slightly narrower. This can make the chair less comfortable and sometimes less easy to open. FIG. 10 and FIG. 11 also show spacers 50 for adjusting the width of the front of the seat. The spacers 50 could be used in other parts of the chair such as between the top of the back members 2.

FIG. 10 and FIG. 11 also show the caps 51 on the ends of some of the back members 2. These back members 2 engage the seat members functioning as leg members 6 and thereby define the angle of the back of the chair. The ends of these back members 2 can receive a lot of wear and breakout (separation of the grain) can sometimes occur. In softer wood versions of the chair, the ends can be compressed and deform over time. The caps 51 help protect the ends but they also serve as a means of the adjusting the angle of the back of the chair. The caps 51 can be removed and spacers (washers, coins, etc.) can be inserted into the caps 51. When the caps 51 are replaced the back of the chair will sit straighter up when in use.

The means for joining the members together comprises a bore though each end of the members in the chair such that the bores of each member operatively align with the bores of the corresponding members with which it is to be joined and an adjustable flexible bolt means 7, is passed through the bores, for stringing together and securing the members under compression. This flexible bolt is described in detail in U.S. Pat. No. 4,743,068 entitled "Knock-Down Furniture Coupling Device" given to the inventor of the present invention. This bolt 7 allows the chair to curve and to be more flexible and therefore more comfortable for the user. This bolt 7 also allows the chairs to be easily assembled by the end user, so the chairs cost less to manufacture and can be sold unassembled.

The foldable chair may include an adjustable head rest apparatus 10 attached to the chair, as shown in FIG. 6. The head rest apparatus 10 of the present invention includes a moveable head rest portion 24 comprising at least two arms 30, at least two spacers 31 separating and connecting the arms 30 and a portion for supporting a head of a user. The apparatus also includes an extension member 21, connected to the chair, upon which the head rest portion 24 can slide up and down, wherein the extension arm 21 can be inserted through the space between the spacers 31 and the arms 30. The head rest portion 24 is connected to and moveable along the extension arm 21 by a length of material 35 and means for retaining the length of material between two points 36 on the extension member 21. The length of material 35 wraps around at least a portion of the head rest portion 24 such that the head rest portion 24 is held in place by the frictional force between the length of material 35 and the head rest portion 24 yet is still movable along the extension arm 21. A piece 32 is attached across the head rest portion 24 for attaching padding 33. This padding 33 can be of various designs and shapes depending on the desires and needs of the user. The arms 30 do not both need to be continuous. A head rest portion 24 could be made wherein one of the arms 30 includes a space just as wide as the extension arm 21. The head rest portion 24 could then be removed from the extension arm 21 by bringing the head rest portion 24 to a perpendicular position relative to the extension arm 21 and then pulling sideways. The head rest portion 24 would normally not come off because it operates in a slightly tilted position so the space would not be functionally wide enough to allow the head rest portion 24 to be removed.

Figure 5:
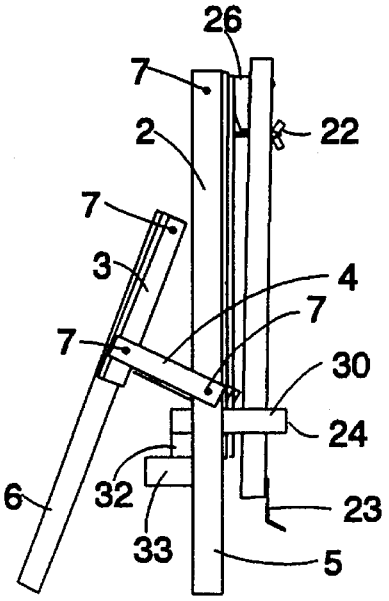
FIG. 5 is a side view of a chair constructed in accordance with the present invention, when the chair is folded.
Figure 3:
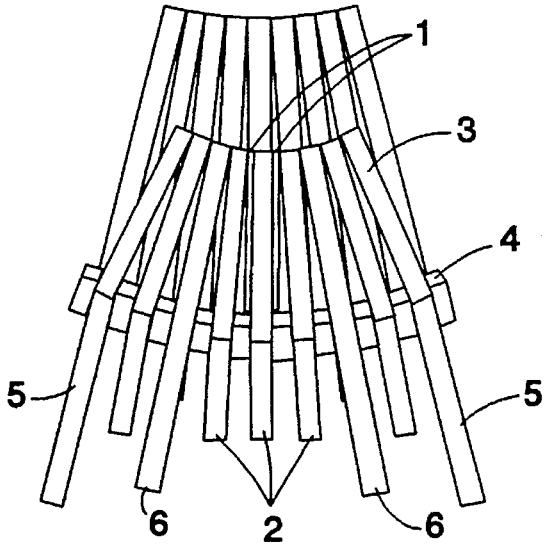
FIG. 3 is a front view of a chair constructed in accordance with the present invention, when the chair is folded.

The adjustable head rest apparatus 10 may include means for supporting an umbrella 40, shown as a metal plate 23. The adjustable head rest apparatus 10 may include means for storing the adjustable head rest apparatus 10 in a compact manner on the chair. As shown, the head rest apparatus 10 is attached to the chair by a bolt 22 and can be rotated from an up position, as shown in FIG. 4, to a down position, as shown in FIG. 5. The adjustable head rest apparatus 10 is folded and secured in a compact manner on the chair by sliding the head rest portion 24 over one end of the extension member 21 while the length of material 35 is still attached and the space between the spacers 31 and the arms 30 of the head rest portion 24 is then placed over on of the back members 2. The head rest apparatus 10 could also be secured by an elastic band stretched over the back of the chair or many other possible means for securing.

The back member 25 that the head rest apparatus 10 is attached to could be angled and the head rest apparatus 10 could include an angled piece 26 such that the head rest would be positioned in a more upright position relative to the back of the chair as desired by the user.

The foregoing description has been directed to particular embodiments of the invention in accordance with the requirements of the Patent Statutes for the purposes of illustration and explanation. It will be apparent, however, to those skilled in this art that many modifications and changes will be possible without departure from the scope and spirit of the invention. It is intended that the following claims be interpreted to embrace all such modifications.

I claim:

1. A foldable chair comprising:

a) back members joined together along the top of said chair;

b) seat members joined together along the front of said chair;

c) leg members extending from said back members and said seat members such that said chair is supported when folded open for use and placed upon a flat surface;

d) intermediate seat members interlaced between said back and said seat members and joined to each of said back and said seat members such that flexible and pivotable joints are formed from connections of one end of said intermediate members to said back members and from connection of the other end of said intermediate members to said seat members, wherein the combined widths of said intermediate seat members and said back members is at least equal to the distance between said connection of any of said intermediate members to an adjacent back member and the top of said adjacent back member and is greater than the length of said seat members; and e) means for joining said back seat and intermediate members of said chair together.

2. The foldable chair of claim 1 further comprising a proportional relationship between the length of the seat members of said chair and the distance between the front of said seat members and the surface on which said chair rests, such that when said chair is unfolded said distance between the front of said seat members and said surface is approximately equal to the length of said seat members, as measured from the front of said seat members to the joint between said seat members and said intermediate members.

3. The foldable chair of claim 1 wherein a proportional relationship exists between the length of said leg members extending from said back members and the length of said leg members extending from said seat members such that said chair remains upright when folded up for storage and folded down for use.

4. The foldable chair of claim 1 wherein said means for joining said back, seat and intermediate members together comprises:

a) a bore though each end of said back, seat and intermediate members in said chair such that said bores of each intermediate member operatively align with said bores of adjacent back and seat members with which it is to be joined; and b) an adjustable flexible bolt means, passing through said bores, for adjustable stringing together and securing said members under compression.

5. The foldable chair of claim 1 wherein back members functioning as leg members are curved toward said seat members when said chair is unfolded for use.

6. The foldable chair of claim 1 further comprising caps for the ends of back members connected to intermediate members also connected to seat members functioning as leg members.

7. The foldable chair of claim 1 wherein the width and height of any back, seat and intermediate members not functioning as leg members are proportioned such that outward force on said means for joining said members caused by the folding and unfolding of said chair is minimized, the overall weight of said chair is minimized, curvature and flexibility of said chair is maximized, and said chair can still support a large person.

8. The foldable chair of claim 7 wherein the width of said back, seat and intermediate members not functioning as leg members is at least equal to the height of said back, seat and intermediate members, wherein the width of said back, seat and intermediate members is defined as a dimension of said back, seat and intermediate members in a direction parallel to said pivotable joints formed by the connection of said intermediate members to said back and seat members and heights of said back, seat and intermediate members are defined by a dimension of said back, seat and intermediate members perpendicular to said width.

9. The foldable chair of claim 1 further comprising an adjustable head rest apparatus attached to said chair.

10. The foldable chair of claim 9 wherein said head rest apparatus comprises:

a) a moveable head rest portion comprising at least two arms, means for separating and connecting said arms and a portion for supporting a head of a user;

b) an extension member, connected to said chair, upon which said head rest portion can slide up and down, wherein said extension member can be inserted through a space between said connecting means and said arms; and c) a length of material and means for retaining said length of material between two points on said extension member wherein said length of material wraps around at least a portion of said head rest apparatus such that said head rest apparatus is connected to and moveable along said extension member yet is held in place by frictional force between said length of material and said head rest apparatus.

11. The foldable chair of claim 9 wherein said adjustable head rest apparatus includes means for supporting an umbrella.

12. The foldable chair of claim 9 wherein said adjustable head rest apparatus includes means for storing said adjustable head rest apparatus in a compact manner on said chair.

13. The foldable chair of claim 12 wherein said adjustable head rest apparatus includes means for folding and securing said adjustable head rest apparatus in a compact manner on said chair such that said head rest portion is slid over one end of said extension member while said length of material is still attached and a space between said connecting means and said arms of said head rest portion function as said means for storing said head rest.

14. A foldable chair comprising:

a) back members joined together along the top of said chair;

b) seat members joined together along the front of said chair;

c) intermediate seat members interlaced between said back and said seat members and joined to each of said back and seat members such that flexible and pivotable joints are formed from connections of one end of said intermediate members to said back members and from connection of the other end of said intermediate members to said seat members;

d) leg members extending from said back members and said seat members such that said chair is supported when folded open for use and placed upon a flat surface;

e) at least one tip prevention member joined along the front of said chair between said seat members such that said tip prevention member can be alternately extended downward or stored when said chair is in use and contacts said flat surface when a person is seated in said chair and said tip prevention member prevents said chair from tipping forward, f) means for joining said back, seat and intermediate members of said chair together.

15. The foldable chair of claim 14 wherein the sum of the widths of said intermediate seat members and said back members is at least equal to the distance between said connection of any of said intermediate members to an adjacent back member and the top of said adjacent back member and is greater than the length of said seat members.

16. The foldable chair of claim 14 wherein a proportional relationship exists between the length of said leg members extending from said back members and the length of said leg members extending from said seat members such that said chair remains upright when folded up for storage and folded down for use.

17. The foldable chair of claim 14 wherein said means for joining said back, seat and intermediate members together comprises:

a) a bore though each end of said back, seat and intermediate members in said chair such that said bores of each intermediate member operatively align with said bores of adjacent back and seat members with which it is to be joined; and b) an adjustable flexible bolt means, passing through said bores, for adjustable stringing together and securing said members under compression.

18. The foldable chair of claim 14 further comprising caps for the ends of back members connected to intermediate members also connected to seat members functioning as leg members.

19. The foldable chair of claim 14 wherein the width and height of any back, seat and intermediate members not functioning as leg members are proportioned such that outward force on said means for joining said back, seat and intermediate members caused by the folding and unfolding of said chair is minimized, the overall weight of said chair is minimized, curvature and flexibility of said chair is maximized, and said chair can still support a person.

20. The foldable chair of claim 16 wherein the width of said back, seat and intermediate members not functioning as leg members is at least equal to the height of said back, seat and intermediate members, wherein the width of said back, seat and intermediate members is defined as a dimension of said back, seat and intermediate members in a direction parallel to said pivotable joints formed by the connection of said intermediate members to said back and seat members and heights of said back, seat and intermediate members are defined by a dimension of said back, seat and intermediate members perpendicular to said width.

21. An adjustable head rest apparatus comprising:

a) a moveable head rest portion comprising at least two arms, spacers for separating and connecting said arms and a portion for supporting a head of a user;

b) an extension member upon which said head rest portion can slide up and down, wherein said extension member can be inserted through a space between said spacers and said arms; and c) a length of material and means for retaining said length of material between two points on said extension member wherein said length of material wraps arounds at least a portion of said head rest apparatus such that said head rest portion is connected to and moveable along said extension member yet is held in place by frictional force between said length of material and said head rest portion.

* * * * *